United States Patent [19]

McComb

[11] 4,078,487

[45] Mar. 14, 1978

[54] CONTROL METHOD AND CONTROL FOR A WEB PROCESSING MACHINE

[75] Inventor: Alan Stuart McComb, Villa Park, Ill.

[73] Assignee: Baldwin-Korthe Web Controls Inc., Addison, Ill.

[21] Appl. No.: 780,412

[22] Filed: Mar. 23, 1977

[51] Int. Cl.[2] ..... B41F 13/02

[52] U.S. Cl. ..... 101/228; 226/11; 101/181

[58] Field of Search ..... 101/228, 219, 220–227, 101/178, 179, 180, 181, 182; 340/259; 226/11, 92

[56] References Cited

U.S. PATENT DOCUMENTS

| | | | |
|---|---|---|---|
| 3,605,618 | 9/1971 | Clasen | 101/228 |
| 3,928,844 | 12/1975 | Meihofer | 101/226 |
| 3,940,954 | 3/1976 | Romoli | 340/259 |
| 3,995,553 | 12/1976 | Winterholler | 101/228 |

*Primary Examiner*—J. Reed Fisher

*Attorney, Agent, or Firm*—St. Onge, Steward, Johnston, Reens & Noe

[57] ABSTRACT

A control for a web processing machine such as for a printing press is described for detecting web breaks, faulty web sensors and inconsistent web threading conditions. A logic network is employed to compare web sensor signals with control signals to detect whether the web sensor signals are consistent with what is called for by associated control signals. Station status signals are produced to stop the machine when inconsistent conditions are sensed and cause appropriate web severing. A bypass control network is provided to inhibit the station status signals for slow speed checkout. However, when the machine speed exceeds a predetermined level, the bypass network is automatically deactivated and full machine control protection restored.

12 Claims, 1 Drawing Figure

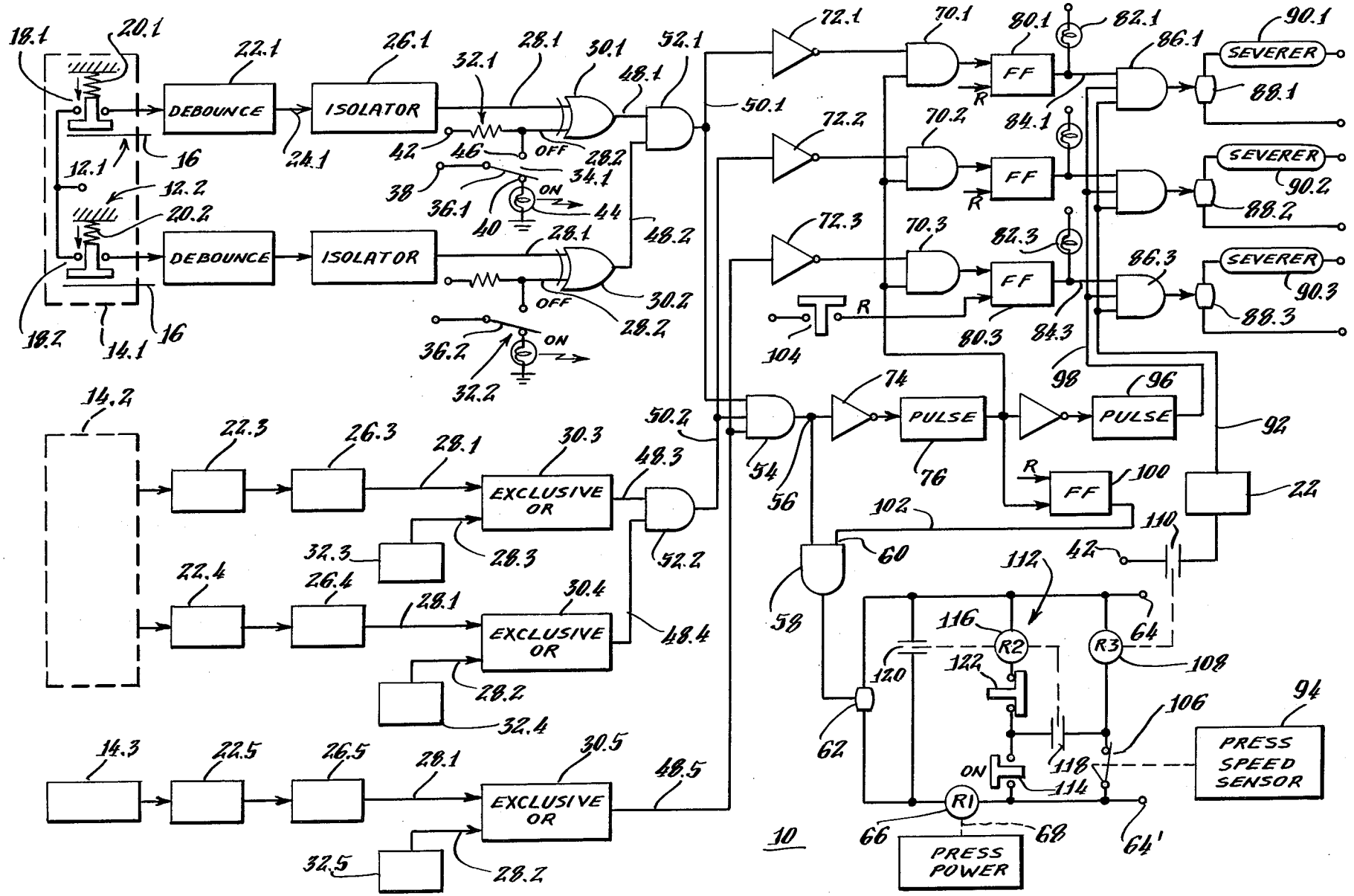
SEVERER
SEVERER
SEVERER
PULSE
PULSE
FF
FF
FF
FF
PRESS SPEED SENSOR
PRESS POWER
ISOLATOR
ISOLATOR
DEBOUNCE
DEBOUNCE
EXCLUSIVE OR
EXCLUSIVE OR
EXCLUSIVE OR
ON
OFF
R1
R2
R3
10

CONTROL METHOD AND CONTROL FOR A WEB PROCESSING MACHINE

This invention generally relates to a control for a machine processing a continuous web. More specifically, this invention relates to a web control for a printing press.

BACKGROUND OF THE INVENTION

Printing presses have been developed capable of producing quality reproductions on paper webs moving at very high speeds through the press. Speeds of the order of one thousand feet per minute are frequently employed.

When a web printing material is moving through a press at such high speed, care must be exercised that the various press components are properly aligned and that the web's integrity is maintained. If a fault occurs such as a break or a reduction in web tension below an acceptable level, the rapidly moving web is likely to jam the printing press, thus causing damage and undesirable lengthy down-time.

Automatically actuated controls to detect such faults and provide immediate protective action such as stoppage of the machine and severing of the web at the proper place have been proposed and are well known.

For example, in the U.S. Pat. No. 3,928,844 to Meihofer, a control is described as capable of automatically detecting a fault and responding with immediate corrective action. The Meihofer patent describes an electronic control for sensing the disappearance of web from a station where it should be in the processing machine, and responding by assuring an immediate machine stoppage and appropriate web severing action.

In a practical press operation, however, it is frequently necessary to change the set-up such as threading of the web past different rollers and thus different stations and accommodating for different web widths. When a set-up change is made by the operator, certain web sensing stations may have to be activated and properly positioned in operative engagement with the web while others are locked out. After a set-up change, the operator may test the operation of the press at low speeds and then resume high-speed printing.

In a large printing press many stations may be employed with a large number of web sensors and web severers. A web sensing head might be defective or an operator error can be made by threading the web past a web sensor which the operator has actually locked out. In such case a prior art press control such as Meihofer would still permit the press to run. The resulting damage to the press and downtime can be very costly.

SUMMARY OF THE INVENTION

In a web control in accordance with the invention, control networks are provided capable of sensing defective web sensors and inconsistent situations such as when a web sensor operatively engages a web while a lock-out control associated with the web sensor indicates that such engagement is not required. The control responds to such situations by inhibiting operation of the processing machine.

As described with respect to a preferred embodiment of the invention, a web signal indicative of the presence or absence of web is applied to one input of a network which provides an exclusive OR logic function. A control signal indicative of whether the web signal is to be coupled in or locked out of the control is applied to another input of the exclusive OR network. Since the network responds with an active output when either one of the inputs is active but not both, the control inhibits machine operation when a web sensor does not work or when web is sensed at a station while the associated control does not call for a web.

In another feature of the invention, a practical web processing machine operation is accommodated with a bypass control network which allows the operator to check out a new set-up. The bypass network prevents web sensors and associated control networks from stopping the machine or severing the web provided the machine speed is below a predetermined speed. When the machine speed rises above this predetermined level, the bypass network is automatically disengaged to permit the web sensors with their associated controls to normally supervise machine operation.

An advantage of the bypass control network is that it permits the web control to register visual fault indications for preoperational check-out without causing web severing or machine stoppage. The operator may then gradually increase the machine speed to its operating level while the safety networks and devices are automatically brought into operation.

It is, therefore, an object of the invention to provide a web control method and a web processing machine control which provide enhanced automatic protection against web sensor defects and operator errors and permit slow speed check-out with automatic activation of control circuits at full operating speed.

These and other advantages and objects of a web processing control in accordance with the invention can be understood from the following description of a preferred embodiment described in conjunction with the drawings.

BRIEF DESCRIPTION OF DRAWING

The drawing is a schematic block diagram representation of a printing press control formed in accordance with the invention.

DETAILED DESCRIPTION OF EMBODIMENT

With reference to the FIGURE, a block diagram of a printing press control 10 in accordance with the invention is shown. The control induces a plurality of web sensors 12 located at suitable stations 14 in a printing press to sense a web 16. The types of sensors 12 which may be used to sense a web in a press or a web break are well known in the art such as shown in U.S. Pat. Nos. 3,823,282 and 3,823,283 which are hereby incorporated by reference. Typically, the web sensor may be an optical device which operatively senses web by utilizing a photo-sensitive element responding to a web 16 passing between a light source and the element. Alternatively, the web sensor may be a normally open mechanical switch such as 18 biased by a spring 20 against the web 16. The switch 18 is activated (closed) when it is in operative engagement with the web 16 while the latter is under the proper mechanical tension. The web sensors 12 may be laterally moved relative to a web 16 to accommodate different web widths.

The web signal from the sensor 12 in the illustrated embodiment is electrical and is passed through a debouncer network 22 to eliminate contact bounce-caused false signals when the web 16 has closed switches 18. Such a debouncer network is well known and regenerates the web signal on line 24 provided the web signal from the sensor 12 has been present for a predetermined minimum time. Note that the debouncer network, as shown, is only required when the web signal from sensor 12 is from a mechanical contact sensor (mechanical switch of any type). If an electronic sensor (electronic solid state semiconductor, e.g. transistor, etc. ) is utilized, the debouncer network may be eliminated.

The web signal from the debouncer network 22 is applied through a transient suppressing coupler 26 to an input 28 of an exclusive OR functioning logic network 30. Such couplers are well known and can be made with an optical coupling device to isolate control 10 from high voltage transients or charges picked up by a sensor 12.

Each web sensor 12 is effectively activated or locked out of control 10 with a control circuit 32 which supplies a control signal to a second input 28.2 of exclusive OR networks 30. The control circuits 32 may be formed with manually activated switches such as 34 having a pole 36 coupled to a logic signal source 38. When the pole 36 is connected to terminal 40 as shown in the FIGURE, the web sensor 12.1 is activated. Thus in the "ON" position, control 32.1 effectively allows a different logic signal source 42 to provide an inactive signal to input 28.2 of exclusive OR network 30.1. In such case, a sensor light 44 is also energized to indicate to an operator that web sensor 12.1 is being used.

When pole 36 is moved to the OFF terminal 46, the logic signal source 38 is applied to input 28.2 of exclusive OR network 30.1 to provide an active input corresponding to the fact that the associated web sensor 12.1 is inactive and not being used.

The network 30 compares its inputs to provide an exclusive OR logic function whereby output 48 becomes active when either one of the inputs 28 are active, but not both. Hence, if control 32 is in the OFF state and web sensor 12.1 senses web, both inputs 28 are active and the output 48 from network 30 goes inactive. The singular symbol employed for exclusive OR network 30 identifies a well known logic function which can be achieved with well known commonly available devices.

In the arrangement of the FIGURE a pair of web sensors 12 are shown employed at station 14.1 to provide a common station status signal on line 50 from an AND gate 52. However, one can employ a single web sensor as suggested at station 14.3 and thus provide a station status signal directly from the output of exclusive OR functioning network 30.5.

The station status signals on lines 50 and 48.5 are all applied to a common AND gate 54 whose output on line 56 provides a press enable signal to enable the press to run. Hence, all status signals must verify proper web sensing in confirmance with the selected position of controls 32 to permit the press to operate. The AND gate 54 may be formed of a single gate or a number of them connected together in a well known manner to attain the described logic function.

The press enable signal is applied through a fault inhibit AND gate 58 having a control input 60 which is disabled when a fault is detected. Assuming that no fault or web break has occurred, the AND gate 58 is enabled by line 60 and the press enable signal applied to a switch 62. When switch 62 is closed, current is allowed to flow from a power source at terminals 64, 64' through a relay 66 which in turn is operatively coupled to activate the press as suggested by dashed line 68.

Whenever a web sensor 12 senses a loss of web, such as may occur from a web break, or when the conditions into the exclusive OR network 30 are no longer satisfied for some other reason, an associated station status signal on a line 48 goes inactive. This in turn removes the press enable signal on line 56 and causes stoppage of the press.

The particular station status signal which registered a fault will enable one of the AND gates 70 through an inverter 72. Essentially simultaneously, the now inactive press enable signal on line 56 operates through an inverter 74 to energize a first pulse generator or timer 76. The latter produces a short strobe pulse, of the order of a millisecond or less, on line 78 to store the fault indicating station status signal into its associated flip-flop storage network 80.

Indicators 82 are coupled to lines 84 of flip-flops 80 to provide visual identification as to which web sensor 12 sensed the initial fault condition. The same flip-flop outputs 84 are coupled through appropriate sever gating networks 86 to switches 88 for controlling power to web severers 90. Sever gates 86 are enabled subject to two signals.

A first signal arises as a result of an enabling signal on line 92 effectively generated by a press speed sensor 94 when the press is operating above a predetermined minimum speed. Below this speed level the sever gates 86 are disabled and inhibited from actuating a web severer 90. This feature allows an operator to test the press at low speeds.

The second signal into gates 90 comes from a pulse generator or timer 96 energized at the end of the strobe pulse from timer 76 to generate a sever pulse on line 98 with sufficient duration to actuate a severer 90. The strobe pulse from timer 76 thus stores the fault, while a web severing action occurs a short instance later.

As soon as the strobe pulse occurs, it actuates an inhibit flip-flop 100 to provide a disabling signal on line 102 to input 60 of AND gate 58. This assures a press disable signal to switch 62 until such time the operator manually activates a reset switch 104. The latter produces a reset signal R to the various storage networks as shown in the FIGURE.

The press speed sensor 94 is a conventional speed cam associated with the press and causes opening of a normally closed speed cam switch 106 above a predetermined speed level, which for the preferred embodiment may be 10 to 20 percent of the normal operating printing press speed. Below this speed level, current flows through a relay coil 108 which in turn closes a relay switch 110. This allows a disabling signal from a voltage source such as 42 to prevent enablement of gates 86 through an appropriate debouncer network 22 and line 92.

An advantageous feature is provided with a manually actuated bypass network 112 which is automatically locked out when the press is operated at normal operating speeds. The network 112 includes a normally open bypass "on" switch 114 which, when actuated, causes a relay 116 to operate.

Actuation of relay 116 causes contacts 118 to latch relay 116 on through the speed control switch 106 and causes a closure of switch 120. This maintains relay 66 energized independent of the condition of switch 62 to allow the press to run. The bypass function can be interrupted by manually actuating the normally closed "OFF" switch 122.

When the press speed goes above the predetermined level, switch 106 is automatically opened. This terminates the bypass function and causes an enabling signal to be applied on line 92 to the sever gates 86. Hence, an operator may check out a newly threaded web at low press speeds without actuation of a severer. If the printing press set-up was improperly executed, the web is defective, or an activated web sensor fails to work, a fault indication will still be registered. When the operator increases the press speed, the bypass network 112 will be automatically reset and an uncorrected fault responded to by stopping the press when the predetermined press speed level is attained.

Having thus described a control for a printing press control in accordance with the invention, its advantages can be appreciated. An operator initially selects and activates the sensing heads 12 to be used by moving the associated control 32 to its "ON" position. With a web 16 under the sensors 12 appropriate station status signals are produced and the press permitted to run.

If a web break is detected by a sensor or a sensor fails, both signals to the associated exclusive OR gate are present and thus the related station status signal rendered inactive. This condition is sensed by AND gate 54 to stop the press by opening switch 62.

The press cannot be restarted until the operator has manually activated the reset switch 104. If the operator passes a web under a sensor 12 which was not activated, the press will not run.

When the operator desires to check out the press or bring it gradually on stream at full operating speed, the bypass network may be used. Press protection is assured when the operation exceeds a predetermined speed level when the bypass network is automatically locked out.

The circuit features illustrated for the preferred embodiment may be varied to accommodate particular needs. For example, the bypass network 112 can be formed with electronic circuits instead of relays. Similarly, switches such as 88 can be electrical or their functions obtained with relays. The entire electronic control may be performed with a microprocessor which is provided with appropriate inputs and program instructions to perform the described logic functions as well as others. For instance, the selection of which severer to actuate when a sensor 12 detects a web break can be determined by appropriate program steps so that one or several severers are actuated as appears necessary to protect the press. Alternately, a variable switching matrix may be inserted between the sever gates 86 and the severers 90 to determine the severing response to a sensor-detected web break.

The preferred embodiment described herein as it relates to a printing press is for illustration, and it should be understood that the invention may be employed with other web processing machines.

What is claimed is:

1. A control for a web processing machine through which a web material is to be threaded for processing comprising sensing means for sensing the web at stations in the machine and producing web signals indicative thereof;

control means for generating control signals individually indicative of whether the web is required to operatively engage the machine at a station thereof;

station status means responsive to the web signals and the control signals for generating station status signals having a fault state indicative that the web has operatively engaged the machine at a station for which an associated control signal indicates that said engagement is not required; and means responsive to the status signals for producing a machine disabling signal when one of said status signals is in a fault state whereby operation of the machine is inhibited when the threading of the web at any one station is inconsistent with its associated control signal.

2. The control for a web processing machine as claimed in claim 1 and further including sever means responsive to the fault state of the status signal for producing a web sever signal to break the web at a status signal determined location in the machine;

machine speed sensing means for producing a machine speed signal indicative of a predetermined machine speed; and means responsive to the machine speed signal for inhibiting said web sever signal from activating a severer below said predetermined machine speed and enabling the web sever signal to operate a severer above said predetermined speed.

3. The control for a web processing machine as claimed in claim 2 and further including a bypass network effectively interposed between the machine disabling signal and the machine to maintain operation of the machine independent of the state of the machine disabling signal, said bypass network being coupled to the machine speed signal for enablement thereby when the machine speed is below said predetermined speed and for disablement above said predetermined speed.

4. The control for a web processing machine as claimed in claim 3 wherein said station status means includes an exclusive OR functioning network for each station and having first and second inputs respectively coupled to the web signal and control signal for the associated machine station.

5. The control for a web processing machine as claimed in claim 4 wherein selected machine stations are provided with a plurality of sensing means and associated control means with a corresponding plurality of exclusive OR functioning networks to assure proper activation of each station selected for operative engagement with the web.

6. The control for a web processing machine as claimed in claim 5 wherein the sever means further includes a plurality of input AND gates individually coupled to a station status signal;

a plurality of storage networks coupled to the input AND gates to store status signals indicative of a fault;

a plurality of output AND gates individually coupled to a storage network and the machine speed signal and having outputs on which said web sever signal is produced;

a strobe pulse producing first timer responsive to the fault state of a station status signal and coupled to enable each of the input AND gates to store a station status fault signal in a storage network; and a second actuating timer energized by the strobe pulse from the first timer and coupled to the output AND gates to produce a web sever signal pulse when the machine is operating above said predetermined speed while a status fault is in a storage network.

7. A control for a printing press through which a web material is to be threaded for printing comprising means for sensing the web at stations in the printing press and producing web signals representative of the operative engagement of web with the printing press at said stations;

means for producing individually selectable printing press station control signals indicative of whether the web is required to operatively engage the associated printing press station;

means associated with individual printing press stations and responsive to the web signals and respectively associated control signals for producing for each station a status signal having a station enabling state indicative that the web has operatively engaged a selected station while an associated control signal indicates that said operative engagement is required, said status signal further having a fault state indicative that the web has operatively engaged the selected station while the associated control signal indicates that said engagement is not required;

means responsive to the status signals for producing a printing press enabling signal when the status signals indicated proper engagement of the web with selected stations and a press disabling signal when one of said status signals is in a fault state.

8. The control for a printing press as claimed in claim 7 and further including a bypass control network effectively coupled to prevent the station status signals from controlling operation of the printing press;

printing press speed sensing means for producing a press speed signal representative of a predetermined operating speed of the press; and means responsive to the press speed signal for automatically deactivating the bypass control network when the press speed signal represents a press speed level above said predetermined operating speed.

9. The control for a printing press as claimed in claim 8 wherein the printing press is provided with web severers coupled to respond to a fault indicating station status signal by severing of the web and further comprising sever gate control means coupled to the press speed signal to inhibit web severer actuations below said predetermined press speed level and enable web severer actuation above said level; and means coupled between the sever gate control means and the station status signal producing means to store and indicate a fault state of a station status signal independent of the press speed signal.

10. A method for protecting a web processing machine operating with a continuous web detected by web sensors located at stations in the press and with web severers for cutting the web comprising the steps of producing web signals indicative of the presence of web at said stations;

generating control signals representative of whether associated web sensors are to be activated;

comparing the web signal from each sensor with the control signal associated with the web sensor;

producing an active station status signal representative of an operative station condition when the comparison indicates that one of the signals being compared is active;

producing an inactive station status signal representative of an inoperative station condition when the comparison indicates that both or neither of the signals being compared are active; and enabling the web processing machine to operate when all of the station status signals indicate an operative condition and inhibiting the web processing machine from operating when any one of the station status signals indicate an inoperative station condition.

11. The method for protecting a web processing machine as claimed in claim 10 and further including the steps of inhibiting operation of station status signals at web processing machine speeds below a predetermined level; and automatically removing said inhibiting action when the web processing machine speed goes above said predetermined level.

12. The method for protecting a web processing machine as claimed in claim 11 and further including the step of inhibiting actuation of web severers during machine speeds below said predetermined level while enabling the indications of station faults to enable a slow speed check-out of the web processing machine.

* * * * *